US006974199B2

(12) United States Patent
Endo

(10) Patent No.: US 6,974,199 B2
(45) Date of Patent: Dec. 13, 2005

(54) PRINTING APPARATUS, STORAGE MEDIUM HAVING A PROGRAM RECORDED THEREON, PATTERN, COMPUTER SYSTEM, AND PRINTING METHOD

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/780,861

(22) Filed: Feb. 19, 2004

(65) Prior Publication Data

US 2004/0160467 A1 Aug. 19, 2004

Related U.S. Application Data

(62) Division of application No. 10/370,070, filed on Feb. 21, 2003.

(30) Foreign Application Priority Data

Feb. 21, 2002 (JP) ..... 2002-045204
Feb. 22, 2002 (JP) ..... 2002-046444
Feb. 22, 2002 (JP) ..... 2002-046445

(51) Int. Cl.[7] ..... B41J 29/38
(52) U.S. Cl. ..... 347/16; 347/19
(58) Field of Search ..... 347/14, 16, 19; 400/74; 399/49, 60

(56) References Cited

U.S. PATENT DOCUMENTS 5,448,269 A * 9/1995 Beauchamp et al. ..... 347/19
6,082,911 A 7/2000 Murakami
6,126,345 A * 10/2000 Ito et al. ..... 400/624
6,137,592 A * 10/2000 Arquilevich et al. ..... 358/1.8
6,439,684 B1 * 8/2002 Yoshimura et al. ..... 347/19
6,769,759 B2 * 8/2004 Yamasaki et al. ..... 347/41
2001/0030671 A1 10/2001 Fujimori

FOREIGN PATENT DOCUMENTS

JP 10-329381 12/1998
JP 11-49399 2/1999
JP 2001-10088 1/2001

* cited by examiner

*Primary Examiner*—K. Feggins
*Assistant Examiner*—Julian D. Huffman
(74) *Attorney, Agent, or Firm*—Sughrue Mion, PLLC

(57) ABSTRACT

A printing apparatus comprises a carry roller for carrying a print sheet. The carry roller has virtual circumference segments that are obtained by virtually dividing a circumference of the carry roller into a plurality of segments in a direction in which the carry roller is rotated, and said printing apparatus is capable of printing a plurality of patterns for each of said virtual circumference segments, each of said patterns corresponding to a different correction amount, and setting a correction amount corresponding to one of the patterns to each said virtual circumference segment.

14 Claims, 9 Drawing Sheets

PRINTING APPARATUS, STORAGE MEDIUM HAVING A PROGRAM RECORDED THEREON, PATTERN, COMPUTER SYSTEM, AND PRINTING METHOD

CROSS-REFERENCE TO RELATED APPLICATIONS

This application is a divisional application of application Ser. No. 10/370,070, filed Feb. 21, 2003, the disclosure of which is incorporated herein by reference. The present application claims priority on Japanese Patent Application No. 2002-45204 filed on Feb. 21, 2002, Japanese Patent Application No. 2002-46444 filed on Feb. 22, 2002, and Japanese Patent Application No. 2002-46445 filed on Feb. 22, 2002, which are herein incorporated by reference.

BACKGROUND OF THE INVENTION

1. Field of the Invention

The present invention relates to a printing apparatus, a storage medium having a program recorded thereon, a correction pattern, a computer system, and a printing method.

2. Description of the Related Art

Printing apparatuses such as inkjet printers comprise: a print head that ejects ink and that is provided on a carriage which performs scanning in the main-scanning direction, and a carrying device that carries a print sheet by a constant carry amount. Such printing apparatuses print by sequentially carrying the print sheet in correspondence with the printing operation of the print head. Thus, in order to achieve good printing, it is necessary to accurately carry the print sheet, and one method for this is disclosed in Japanese Patent Application Laid-open Publication No. 11-49399 (U.S. Pat. No. 6,101,426), which discloses a printing apparatus provided with a carrying device. A carry error, which appears at a specified period as the carry roller for carrying the print sheet rotates, is measured for the carrying device, this period is divided into a plurality of sections, and correction values of the carry errors for each section are set to the carry device during the manufacturing stage; the carry device carries the print sheet after the carry amount is corrected using the correction values.

However, for example, differences in the environment in which the printing apparatus is used, differences in the amount of change in the shape of the carry roller due to the thickness of the print sheet, and differences in the coefficient of friction among different types of print sheets, may change the carrying of the print sheets. This results in the problem that even if correction values for carry errors are set during manufacturing, the correction values that are set in the manufacturing stage may not always be the most appropriate depending on the usage environment of the user or the print sheets that are used, leading to instances where the print sheet is not carried appropriately.

Thus, a configuration that allows the user to correct the carry amount is preferable; however, if, as in the above, it is desired that the print sheet is carried with enough accuracy that the slightest change in the condition of the carry roller has to be corrected, then, to perform a more accurate correction, it is necessary to increase the number of sections into which the period is divided and to allow a large number of correction values to be set to each section. However, if the number of sections or the number of correction values is increased, although it may be possible for the user to correct the carry amount, it is difficult for users to determine an appropriate value for the correction amount, and no proposal has been made for determining means that allow this to be determined easily.

SUMMARY OF THE INVENTION

An aspect of the invention has been made in light of the aforementioned problem, and it is an object thereof to print a carry amount correction pattern for determining the correction amount of the carry amount of the print sheet for each predetermined section obtained by segmenting.

A main invention for achieving the foregoing object is a printing apparatus comprising: a carry roller for carrying a print sheet; wherein the carry roller has virtual circumference segments that are obtained by virtually dividing a circumference of the carry roller into a plurality of segments in a direction in which the carry roller is rotated, and the printing apparatus is capable of printing a plurality of patterns for each of the virtual circumference segments, each of the patterns corresponding to a different correction amount, and setting a correction amount corresponding to one of the patterns to each virtual circumference segment.

Features and objects of the present invention other than the above will become clear by reading the description of the present specification with reference to the appended drawings.

Figure 1:
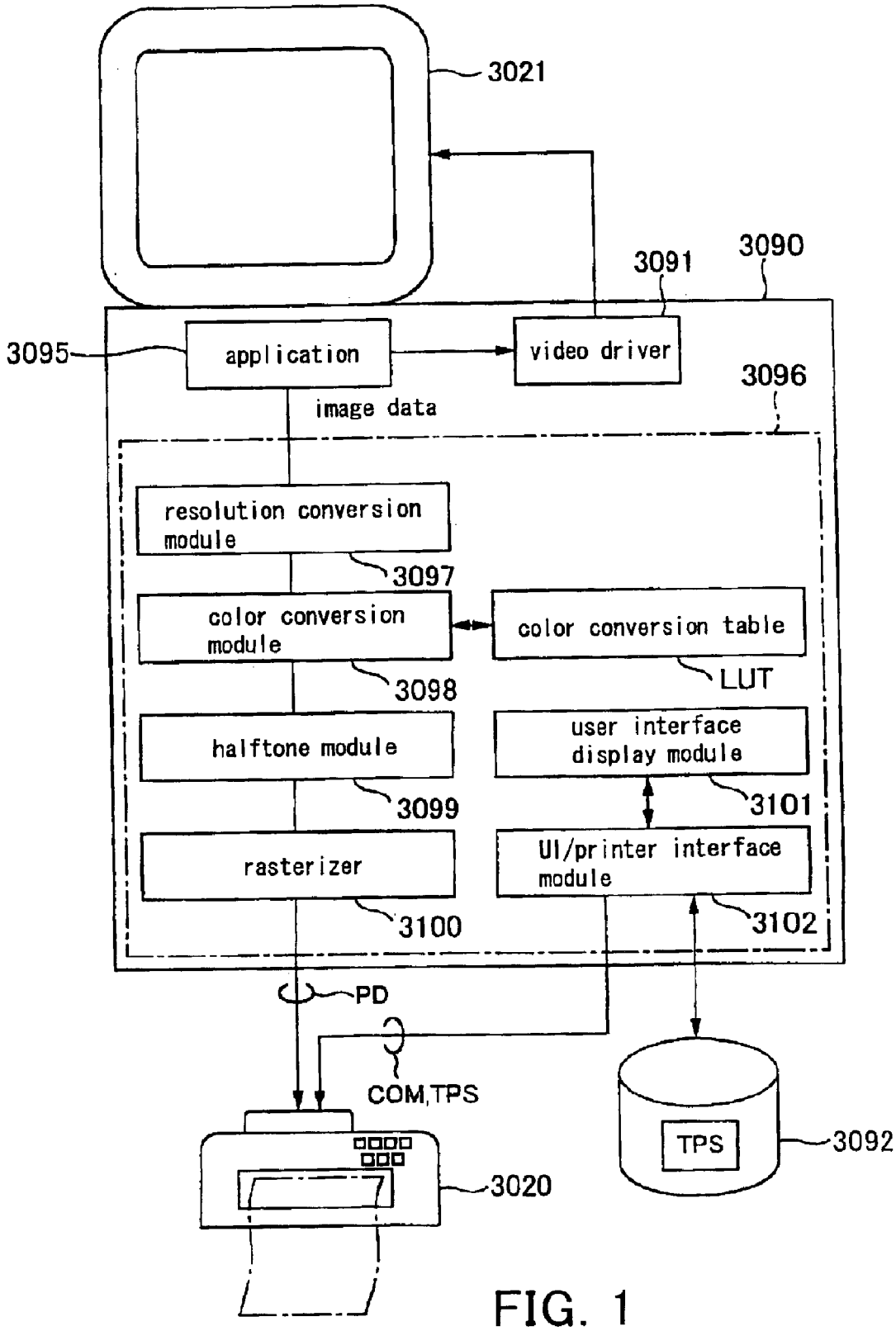
FIG. 1 is a block diagram showing the configuration of a printing system serving as an example of the present invention.

For a more complete understanding of the present invention and the advantages thereof, reference is now made to the following description taken in conjunction with the accompanying drawings.

DESCRIPTION OF PREFERRED EMBODIMENTS

<Outline of the Disclosure>

At least the following matters will be made clear by the explanation in the present specification and the description of the accompanying drawings.

A printing apparatus comprises:

a carry roller for carrying a print sheet;

wherein the carry roller has virtual circumference segments that are obtained by virtually dividing a circumference of the carry roller into a plurality of segments in a direction in which the carry roller is rotated, and the printing apparatus is capable of printing a plurality of patterns for each of the virtual circumference segments, each of the patterns corresponding to a different correction amount, and setting a correction amount corresponding to one of the patterns to each virtual circumference segment.

According to this printing apparatus, patterns used for setting correction amounts for correcting the carry amount of each virtual circumference segment, which are obtained by virtually segmenting the circumference, can be printed for each virtual circumference segment, while associating the patterns with each of the correction amounts.

In this printing apparatus, it is preferable that the printing apparatus is capable of forming the pattern for determining a correction amount for a predetermined virtual circumference segment by printing a predetermined structural pattern before and after the print sheet is carried by that virtual circumference segment of the carry roller. According to such a printing apparatus, it is possible to ascertain the correction amount of a particular virtual circumference segment using predetermined structural patterns printed before and after the print sheet is carried.

In this printing apparatus, it is preferable that the patterns, which correspond to the correction amounts for each of the virtual circumference segments, are arranged in a row in a carry direction of the print sheet for each of the virtual circumference segments, and the pattern rows, which are arranged in rows, are printed on a single print sheet next to each other in a direction that is perpendicular to the carry direction. According to this printing apparatus, it becomes possible to print patterns corresponding to each correction amount for each virtual circumference segment on a single print sheet.

In this printing apparatus, it is preferable that the plurality of patterns for each of the virtual circumference segments corresponding to one correction amount are formed starting from a front end side of the print sheet in order of formation of the patterns. According to this printing apparatus, the patterns are formed in order from the front end of the print sheet, and thus, since it is not necessary to retract the print sheet, that has once been fed, for printing, printing can be carried out in a short period of time.

In this printing apparatus, it is preferable that the printing apparatus is capable of forming a pattern group by forming patterns for each of the virtual circumference segments corresponding to one correction amount, and changing the correction amount each time the carry roller makes a full turn and forming the pattern group made of patterns corresponding to the correction amount that has been changed. According to such a printing apparatus, since the correction amount is not changed as patterns are being formed in correspondence with the rotation of the carry roller, it becomes possible to perform printing efficiently.

In this printing apparatus, it is preferable that the printing apparatus further includes a print head for printing while performing scanning in a direction that is perpendicular to a carry direction of the print sheet; wherein as for two adjacent patterns that make up one of the pattern groups, a structural pattern printed before carrying in one pattern and a structural pattern printed after carrying in another pattern are printed during the same scan of the print head. According to this printing apparatus, two structural patterns are printed while the print head performs scanning once, and thus printing can be carried out efficiently.

In this printing apparatus, it is preferable that the print head has a plurality of nozzles that are arranged in the carry direction of the print sheet and that are capable of ejecting ink; the patterns are formed using some of the nozzles; and nozzles forming the structural pattern printed after the carrying by a particular virtual circumference segment are located more toward the front end of the print sheet than nozzles forming the structural pattern printed before the carrying. According to this printing apparatus, after the print sheet has been carried, printing can be carried out with respect to the position printed before carrying, without retracting the print sheet.

In this printing apparatus, it is preferable that a length of each pattern in the carry direction is shorter than a product of an amount the print sheet is carried and a number into which the carry roller is virtually divided. According to this printing apparatus, it becomes possible to prevent printing a new pattern over a pattern that has already been printed.

In this printing apparatus, it is preferable that the structural pattern is made of a plurality of lines spaced at an equal spacing in a carry direction of the print sheet, or dot rows arranged in a direction that is perpendicular to the carry direction, and a correction amount corresponding to the pattern in which the lines or the dot rows of the structural pattern that is printed after carrying are formed at a position that evenly divides a space between the lines or the dot rows of the structural pattern that is printed before carrying the print sheet is set. According to this printing apparatus, when the structural pattern printed after carrying is printed in the ideal print position, the density of the pattern that is formed appears dark; therefore, a suitable correction amount can be determined easily based on the darkness of the pattern that is formed.

In this printing apparatus, it is preferable that the structural pattern is made of a plurality of lines spaced at an equal spacing in a carry direction of the print sheet, or dot rows arranged in a direction that is perpendicular to the carry direction, and a correction amount corresponding to the pattern in which the lines or the dot rows of the structural pattern that is printed after carrying are formed at a position that overlaps the lines or the dot rows of the structural pattern that is printed before carrying the print sheet is set. According to this printing apparatus, when the structural pattern printed after carrying is printed in the ideal print position, the density of the pattern that is formed appears light; therefore, a suitable correction amount can be determined easily based on the darkness of the pattern that is formed.

It should be noted that in addition to a printing apparatus, a carry amount correction pattern, a program, a computer system, and a printing method are also described.

<Example of Overall Configuration of Apparatus>

FIG. 1 is a block diagram showing the configuration of a printing system.

This printing system includes a computer 3090 and a color inkjet printer 3020 as an example of a printing apparatus. It should be noted that the printing system including the color inkjet printer 3020 and the computer 3090 can also be broadly defined as a "printing apparatus." Also, although not shown in the drawing, a computer system is made up of the computer 3090, the color inkjet printer 3020, a display device such as a CRT 3021 or a liquid crystal display device, an input device such as a keyboard or a mouse, and a drive device such as a flexible drive device or a CD-ROM drive device.

With the computer system 3090, an application program 3095 operates under a predetermined operating system. To the operating system are incorporated a video driver 3091 and a printer driver 3096; via these drivers, print data PD to be transferred to the color inkjet printer 3020 is output from the application program 3095. The application program 3095, which is, for example, for image retouch, carries out a requested process with respect to an image to be processed and displays images on the CRT 3021 via the video driver 3091.

When the application program 3095 sends a print order, the printer driver 3096 of the computer 3090 receives image data from the application program 3095 and converts it into print data PD to be supplied to the color inkjet printer 3020. The printer driver 3096 is internally provided with a resolution conversion module 3097, a color conversion module 3098, a halftone module 3099, a rasterizer 3100, a user interface display module 3101, a UI/printer interface module 3102, and a color conversion lookup table LUT.

The resolution conversion module 3097 has the function of converting the resolution of color image data formed by the application program 3095 into the print resolution. The image data that is thus converted in resolution is still image information composed of the three color components RGB. The color conversion module 3098 refers to the color conversion lookup table LUT as it converts the RGB image data for each pixel into multi-gradation data of a plurality of ink colors and that can be used by the color inkjet printer 3020.

The multi-gradation data having been converted in color has a gradation value of 256 scales, for example. This data is subjected to so-called "halftone processing" by the halftone module 3099, creating halftone image data. The halftone image data is rearranged by the rasterizer 3100 in the order of data transfer to the color inkjet printer 3020, and is output as the final print data PD. The print data PD includes raster data indicating how dots are to be formed during each main scanning and data indicating the feed amount in sub-scanning.

The user interface display module 3101 has a function for displaying various types of user interface windows related to printing and a function for receiving user input through those windows.

The UI/printer interface module 3102 has a function for acting as an interface between the user interface (UI) and the color inkjet printer. It interprets orders given by the user through the user interface and transmits various commands COM to the color inkjet printer, and alternatively, interprets the commands COM received from the color inkjet printer and performs various displays to the user interface. The UI/printer interface module 3102 also has a function for reading out test pattern print signals TPS about test patterns including carry amount correction patterns, which are described later, from a hard disk 3092, and supplying these to the color inkjet printer 3020.

It should be noted that the printer driver 3096, for example, achieves a function for sending and receiving various types of commands COM and a function for supplying print data PD and test pattern print signals TPS to the color inkjet printer 3020. A program for realizing the functions of the printer driver 3096 is supplied in a form in which it is stored on a computer-readable storage medium. Various types of computer-readable media can be used as such a storage medium, including flexible disks, CD-ROMs, magneto-optic disks, IC cards, ROM cartridges, punch cards, printed material on which a code such as a barcode is printed, memory devices (memories such as a RAM or ROM) inside a computer, and memory devices outside a computer. Also, such a computer program can be downloaded to the computer 3090 via the Internet.

Figure 2:
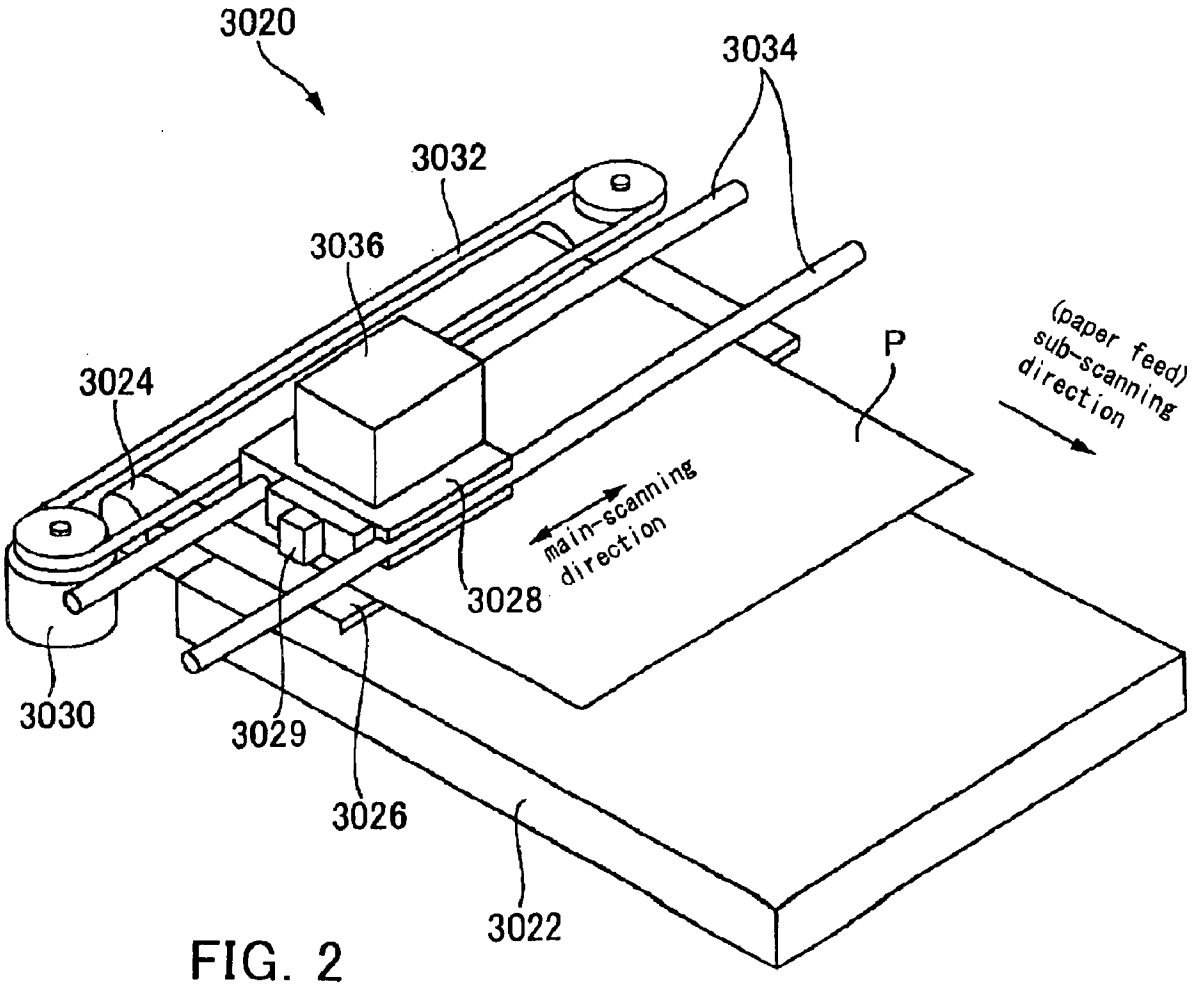
FIG. 2 is a perspective view that schematically shows an example of a primary configuration of a color inkjet printer 3020.

FIG. 2 is a perspective view that schematically shows an example of some main structures of the color inkjet printer 3020. The color inkjet printer 3020 comprises: a paper stacker 3022; a paper carry roller 3024, which is driven by a step motor that is not shown; a platen 3026; a carriage 3028; a carriage motor 3030; a pull belt 3032 driven by the carriage motor 3030; and a guide rail 3034 for the carriage 3028. Also, a print head 3036 provided with numerous nozzles and a reflection-type optical sensor 3029, which is described in detail later, are mounted on the carriage 3028.

The perimeter of the paper carry roller 3024 is set to one inch, for example, for the sake of convenience in correcting the carry amount, and on the shaft end of the paper carry roller 3024 are provided: a position detection sensor, which is not shown, for detecting a certain position that serves as the reference position of the paper carry roller 3024; and an encoder 3035 for detecting the rotation position (rotation angle) from the reference position. The encoder 3035 is configured so that it can detect a precise rotation position at a precision of an integral submultiple of the smallest paper carry amount that can be carried by the paper carry roller 3024, and based on a signal of the encoder 3035, the print sheet is aligned or the carry amount of the paper carry roller 3024 is corrected. Correction of the carry amount will be described in detail later.

The print sheet P is taken up from the paper stacker 3022 by the paper carry roller 3024 and is delivered in the sub-scanning direction over the surface of the platen 3026. The carriage 3028 is drawn by the pull belt 3032, which is driven by the carriage motor 3030, and moved in the main-scanning direction along the guide rail 3034.

It should be noted that the main-scanning direction indicates the direction in which the carriage 3028 is moved back and forth along the guide rail 3034, whereas the sub-scanning direction indicates the single direction in which the paper sheet P is delivered over the surface of the platen 3026. The main-scanning direction is perpendicular to the sub-scanning direction.

Also, the paper supply operation for supplying the print sheet P to the color inkjet printer 3020 and the paper discharge operation for discharging the print sheet P from the color inkjet printer 3020 are performed using the paper carry roller 3024.

<Example Configuration of the Reflection-type Optical Sensor>

Figure 3:
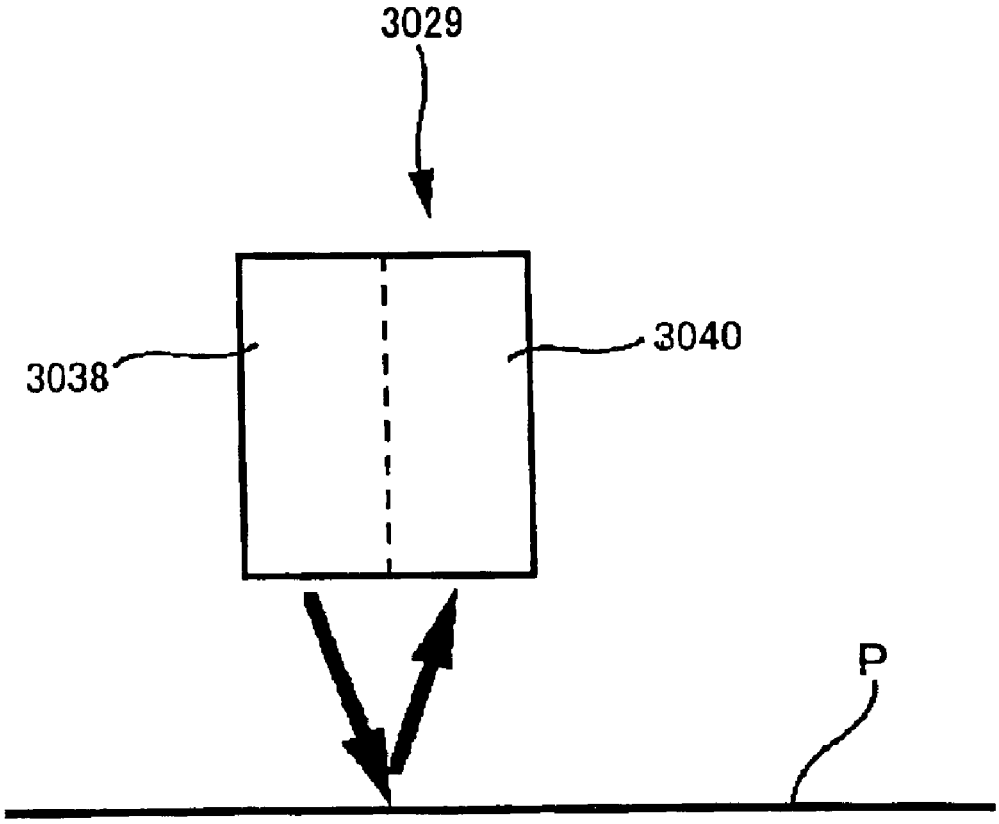
FIG. 3 is a schematic drawing for describing an example of a reflection-type optical sensor 3029.

FIG. 3 is a schematic drawing for describing an example of the reflection-type optical sensor 3029. The reflection-type optical sensor 3029 is attached to the carriage 3028, and has a light-emitting section 3038 that is made of, for example, a light-emitting diode, and a light-receiving section 3040 that is made of, for example, a phototransistor. The light that has been emitted from the light-emitting section 3038, that is, the incident light, is reflected by the print sheet P, and the reflected light is received by the light-receiving section 3040 and converted into an electrical signal. The magnitude of the electrical signal is measured as the output value of the light-receiving sensor corresponding to the intensity of the reflected light that has been received.

It should be noted that in the above description, as shown in the drawing, the light-emitting section 3038 and the light-receiving section 3040 are configured into a single unit as a device that serves as the reflection-type optical sensor 3029; however, they may each constitute separate devices, such as a light-emitting device and a light-receiving device.

Also, in the above description, in order to obtain the intensity of the reflected light that is received, the magnitude of the electric signals is measured after the reflected light is converted into electrical signals; however, this is not a limitation, and it is sufficient if the output value of the light-receiving sensor corresponding to the intensity of the received reflected light can be measured.

<Example of the Electrical Configuration of the Color Inkjet Printer>

Figure 4:
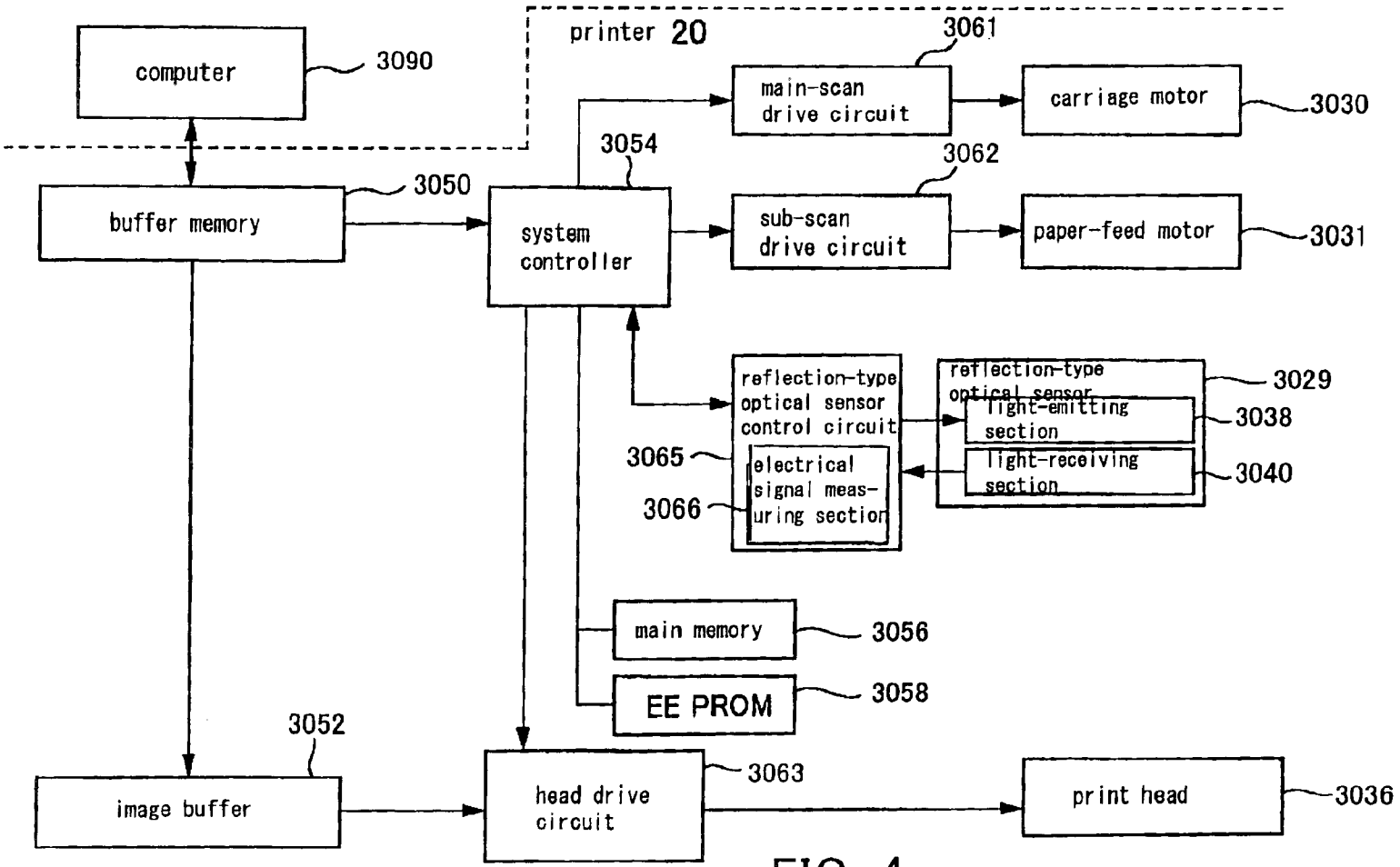
FIG. 4 is a block diagram showing an example of the electrical configuration of the color inkjet printer 3020.

FIG. 4 is a block diagram showing an example of the electrical configuration of the color inkjet printer 3020. The color inkjet printer 3020 comprises: a buffer memory 3050 for receiving signals supplied from the computer 3090; an image buffer 3052 for storing print data; a system controller 3054 for controlling the overall operation of the color inkjet printer 3020; a main memory 3056; and an EEPROM 3058. Also, to the system controller 3054 are connected: a main-scan drive circuit 3061 for driving the carriage motor 3030; a sub-scan drive circuit 3062 for driving the paper carry motor 3031; a head drive circuit 3063 for driving the print head 3036; and a reflection-type optical sensor control circuit 3065 for controlling the light-emitting section 3038 and the light-receiving section 3040 of the reflection-type optical sensor 3029. The reflection-type optical sensor control circuit 3065 is provided with an electrical signal measuring section 3066 for measuring the electrical signals that are converted from the reflected light received by the light-receiving section 3040.

The print data that are transferred from the computer 3090 is temporarily held in the buffer memory 3050. Inside the color inkjet printer 3020, the system controller 3054 reads necessary information from the print data in the buffer memory 3050, and based on the data, sends control signals to the main-scan drive circuit 3061, the sub-scan drive circuit 3062, and the head drive circuit 3063.

Print data for a plurality of color components are received by the buffer memory 3050 and stored in the image buffer 3052. The head drive circuit 3063 reads the print data for each color component from the image buffer 3052 in accordance with the control signal from the system controller 3054, and drives the nozzle rows for each color, which are provided in the print head 3036, according to the print data.

<Example of the Nozzle Configuration of the Print Head>

Figure 5A:
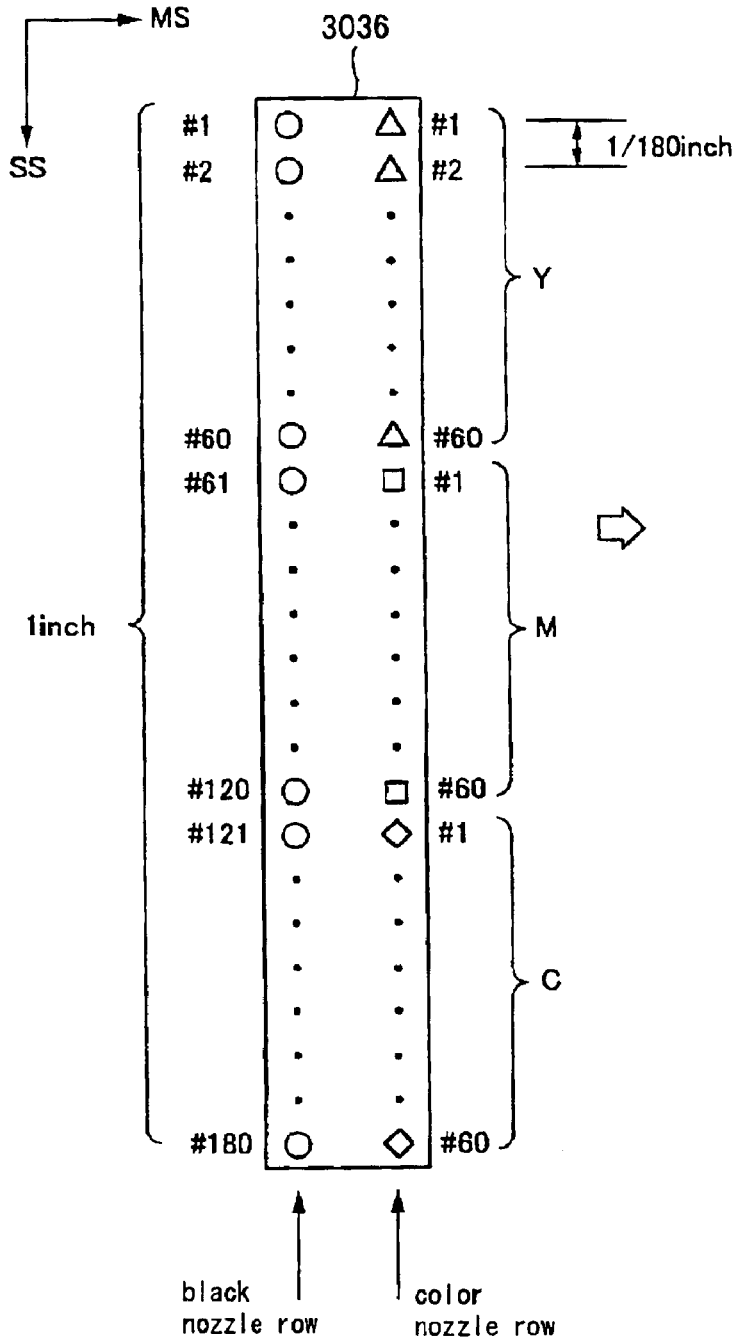
FIG. 5A is an explanatory diagram showing the nozzle arrangement in the lower surface of a print head 3036.
Figure 5B:
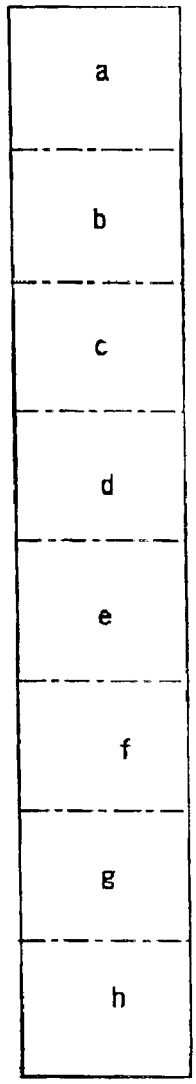
FIG. 5B is an explanatory diagram showing the arrangement of the nozzle groups.

FIG. 5A is an explanatory diagram showing the nozzle arrangement in the lower face of the print head 3036. FIG. 5B is an explanatory diagram showing the arrangement of the nozzle groups. First, from FIG. 5A, it is clear that the print head 3036 has a black nozzle row and a color nozzle row both arranged in straight lines in the sub-scanning direction SS.

The black nozzle row (shown by the empty circles) has 180 nozzles, #1 to #180. The nozzles #1 to #180 are arranged at a constant dot pitch in the sub-scanning direction. Here, for the sake of correcting the carry amount, the size of the print head 3036 is set to one inch, for example, to match the perimeter of the paper carry roller 3024.

That is, using the print head 3036, when printing with a paper carry amount of one inch and carrying the sheet as a band, an image of 180 dpi is printed.

The color nozzle row has 60 nozzles each of yellow nozzles Y (shown by empty triangles), magenta nozzle groups M (shown by empty squares), and cyan nozzle groups C (shown by empty diamonds), and is arranged at the same nozzle pitch in the sub-scanning direction as the black nozzle row.

During printing, the print head 3036 moves at a constant speed in the main-scanning direction together with the carriage 3028, and ink is ejected from each of the nozzles. However, depending on the printing mode, there may be cases where all nozzles are not always be used and only some of the nozzles are used.

<Outline of the Carry Amount Correction Pattern>

Figure 6:
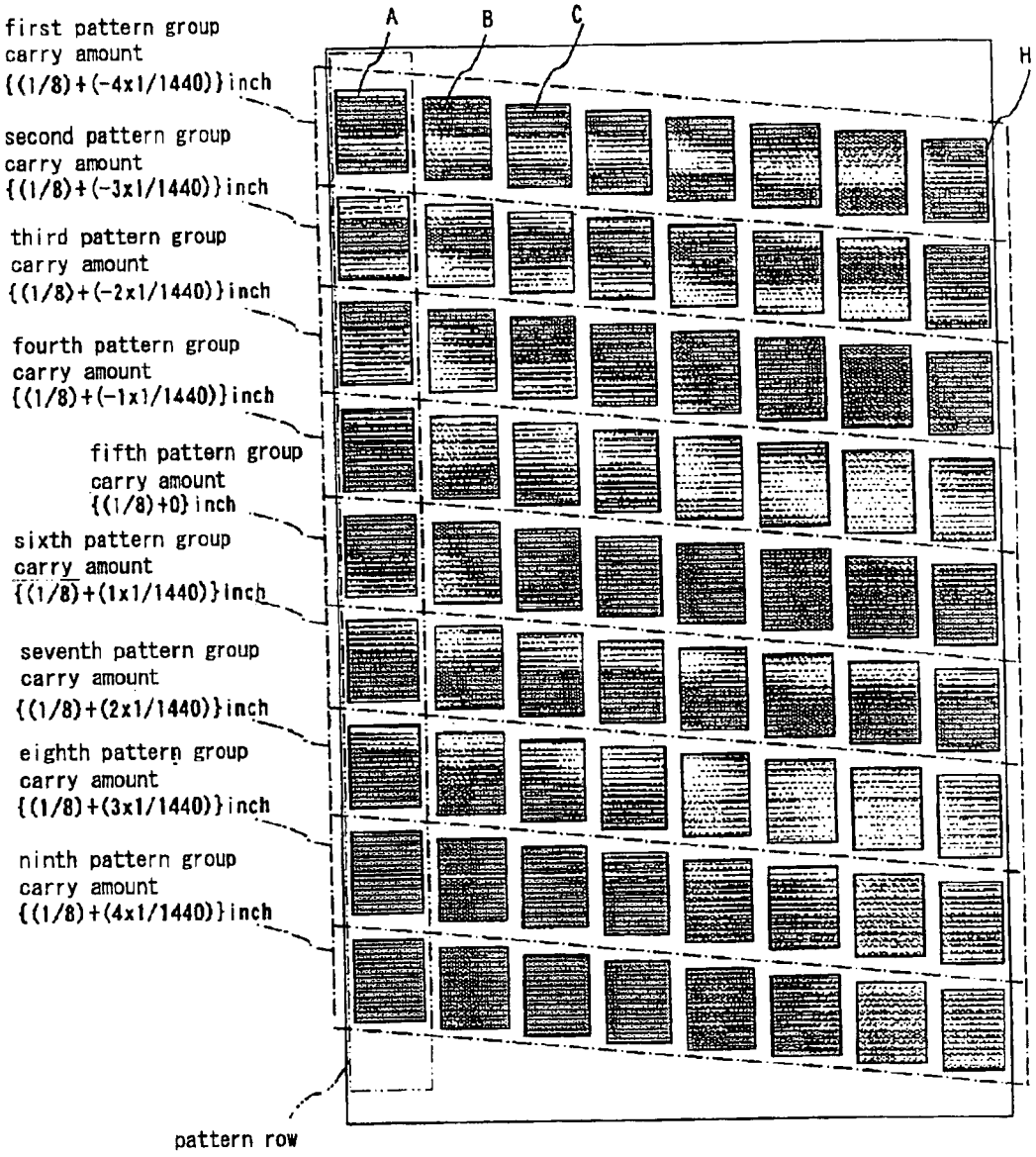
FIG. 6 is an explanatory diagram showing an example of the carry amount correction pattern.

FIG. 6 shows an example of the carry amount correction pattern.

Figure 7:
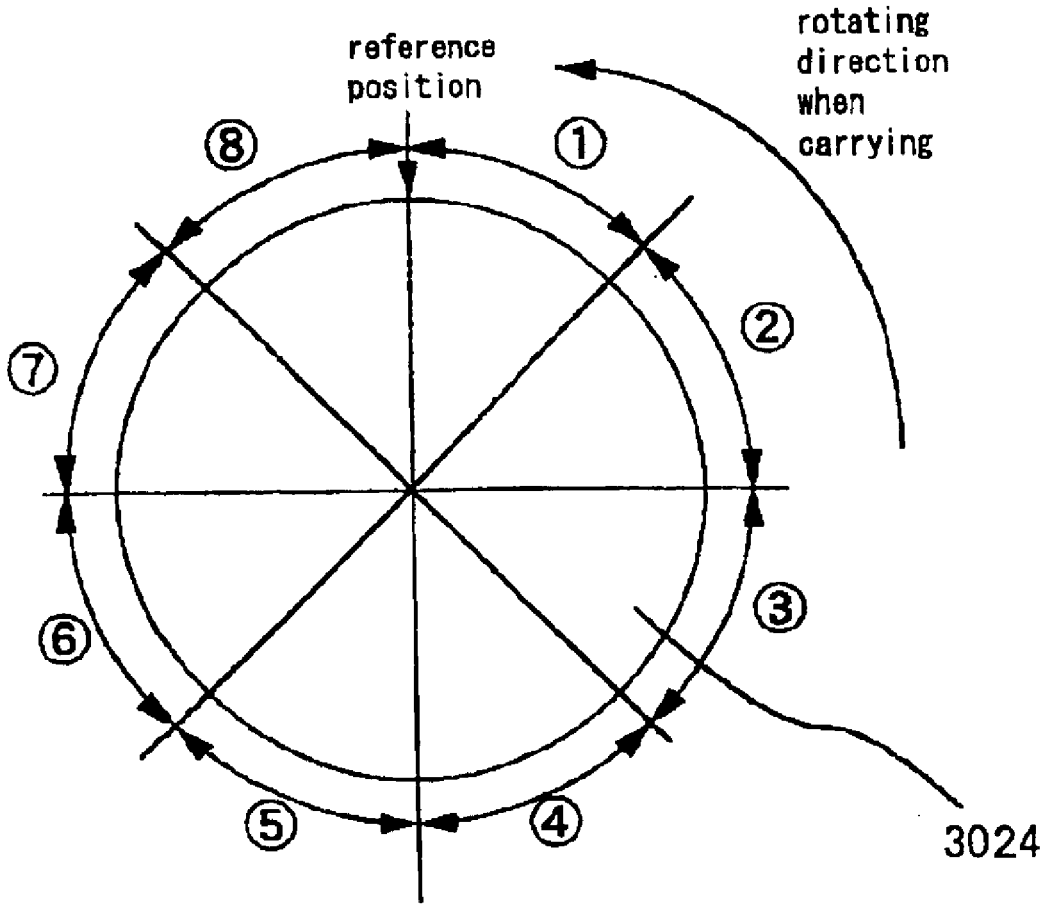
FIG. 7 is an explanatory diagram showing an example of the virtual segments of the paper carry roller 3024.

In this embodiment, as shown in FIG. 7, the circumference of the paper carry roller 3024 is virtually segmented into eight circumferences (1) to (8) in the direction in which it is rotated, in such a manner that the central angles thereof are equal. As mentioned above, the perimeter of the paper carry roller 3024 is set to one inch; therefore, by each virtual circumference segment, the print sheet is carried approximately ⅛ inch. Also, to each virtual circumference segment are set nine types of correction amounts, that is, correction amounts with which the carry amount can be increased or decreased to a correction amount that is as much as four times the smallest correction unit, taking a correction amount of zero as the standard. Here, the smallest correction unit is equal to the smallest paper-carry amount, and the smallest paper-carry amount is set, for example, to $1/1440$ inch or $1/2880$ inch, depending on the printing apparatus.

In the following, a carry amount correction pattern used for determining the correction amount for correcting the carry amount (approximately ⅛ inch) of each virtual circumference segment from the nine types of correction amounts is described.

The carry amount correction pattern is, for example, printed on A4 size white paper, and in the printer, the longitudinal direction is regarded as the paper-carry direction. Eight pattern rows, in which nine patterns are arranged forming a row in the longitudinal direction, are lined up in the lateral direction for each of the eight virtual circumference segments into which the carry roller 3024 is virtually segmented. The patterns are for determining a correction amount for each virtual circumference segment, with the pattern row arranged the furthest to the left among the eight rows corresponding to the virtual circumference segment (1) of the carry roller 3024, and the pattern row arranged the furthest to the right corresponding to the virtual circumference segment (8). Also, the pattern rows are lined up in such a manner that the pattern at the front end of the paper corresponds to (standard carry amount)+(−4×smallest paper carry amount), and the correction amounts added to the standard carry amount are (−3×smallest paper carry amount), (−2×smallest paper carry amount), . . . , (3×smallest paper carry amount), (4×smallest paper carry amount) in order from the front end.

Each pattern is formed by printing a structural pattern before and after the print sheet is carried by each virtual circumference segment. Here, a structural pattern is dot rows lined up in the main-scanning direction or lines formed by connected dots, and is formed by ink that is ejected from predetermined nozzles of the print head as scanning is performed with the print head. In this embodiment, dot rows of 180 dpi are printed in the sub-scanning direction. At this time, the size of the structural patterns in the sub-scanning direction is set sufficiently larger than the carry amount at which the print sheet is carried by the virtual circumference segments. Here, for example, the size of the structural patterns in the sub-scanning direction is set to ½ inch, which is four times the ⅛ inch carry amount of each virtual circumference segment, half of the nozzles of the nozzle rows that are provided in the print head 3036 are used for printing, and only the black nozzles are used.

Also, the nozzles that are used to print a structural pattern after the print sheet has been carried are located more toward the front end of the print sheet by the carry amount than the nozzles that are used when printing before carrying the print sheet. For example, the nozzles that are provided in the print head 3036 are divided into eight regions, a through h, as shown in FIG. 5B, and among them, the nozzles that are used for printing before the print sheet is carried are regarded as an α nozzle group arranged in regions c to f, and the nozzles that are used for printing after carrying are regarded as a β nozzle group arranged in regions b to e. Thus, if the carry amount at which the print sheet is carried by a predetermined virtual circumference segment is correct, then the dots of the structural pattern that is printed before carrying the print sheet and the dots of the structural pattern that is printed before carrying are printed so that they overlap one another. Also, if there is an error in the carry amount, then the dots of the structural patterns printed before and after carrying will be printed in positions shifted by that error amount. If the dots of the structural patterns that are printed before and after carrying are printed so that they overlap one another, then much of the underlying white color will remain and the density of the pattern will be low, whereas if the dots are printed at misaligned positions, then the amount of underlying white color will be reduced, thus increasing the density of the pattern.

In other words, a pattern row, which is made of nine patterns, corresponds to a specific virtual circumference segment, and by respectively adding nine types of correction amounts to the standard carry amount as the carry amount for that virtual circumference segment, many patterns obtained when the print sheet is carried at a slightly different carry amount will be formed. Consequently, if carrying is performed after adding the correction amount, among the nine types of correction amounts, that will cancel the carry error, then the dots of the structural patterns that are printed before and after carrying will overlap each other and a pattern with a low density will be printed; for the other patterns, the structural patterns will be shifted from each other and a pattern with a high density will be printed. Thus, by selecting the correction amount, with which a pattern having a low density is formed, from each pattern row of the carry amount correction pattern having been printed and by correcting the carry amount of the virtual circumference segment by that correction amount, the precision with which the print sheet is carried can be increased.

A pattern with a low density may be selected from the pattern rows by a user or the like who makes a decision after viewing the patterns. Another approach is to perform settings so that the carry amount correction pattern having been printed is carried by the printer, the pattern is scanned by the above-described reflection-type optical sensor 3029, and the pattern having the largest output from the reception sensor is selected.

<Operation for Printing the Carry Amount Correction Pattern>

Figure 8:
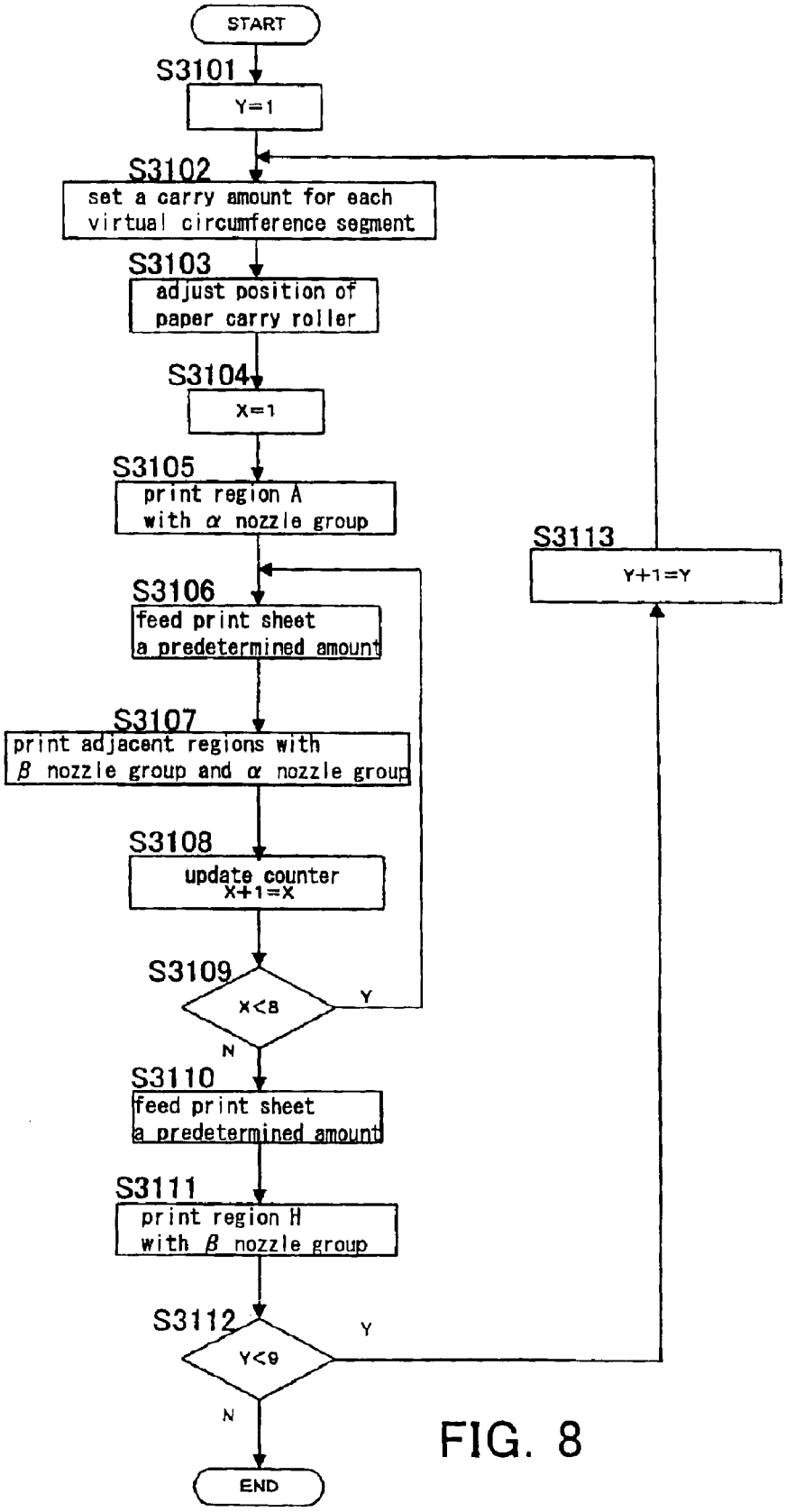
FIG. 8 is a flowchart for describing the printing operation of the carry amount correction pattern of this embodiment.
Figure 9A:
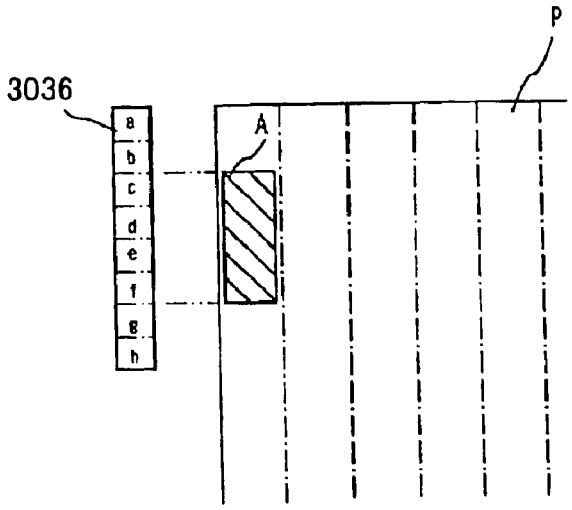
FIG. 9A, FIG. 9B, and FIG. 9C are explanatory diagrams showing an overview of the method for printing the carry amount correction pattern.
Figure 9B:
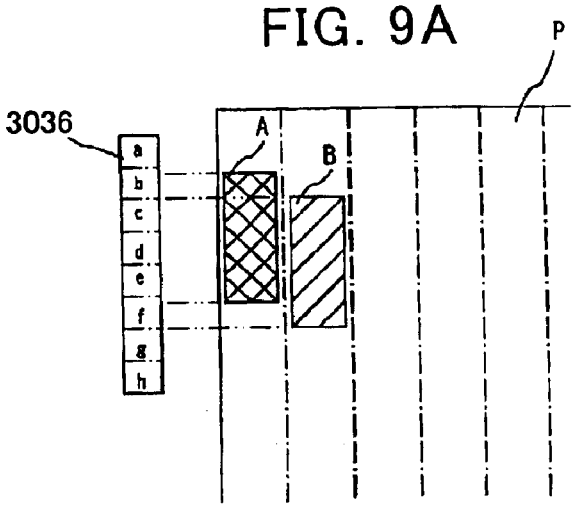
Figure 9C:
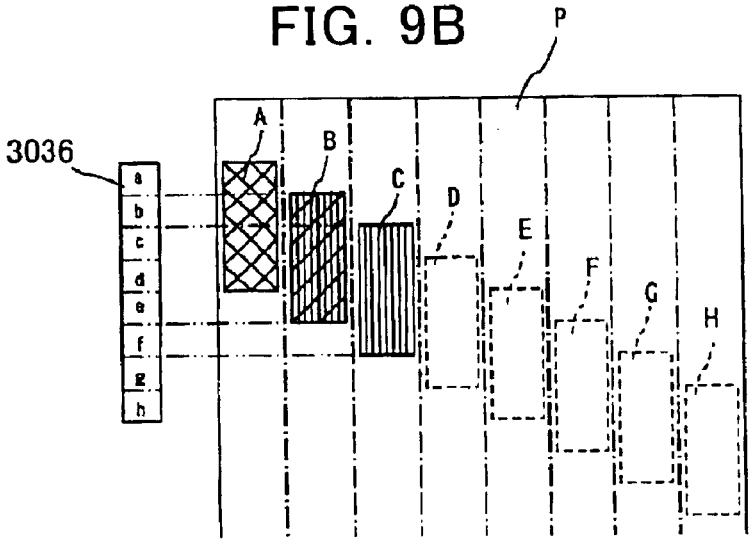

An embodiment of the operation for printing the carry amount correction pattern mentioned above is described using FIG. 8, FIG. 9A, FIG. 9B, and FIG. 9C. FIG. 8 is a flowchart for describing an example of an embodiment in which the carry amount correction pattern is printed. FIG. 9A to FIG. 9C are explanatory diagrams showing an outline of the method for printing the carry amount correction pattern.

In this embodiment, a case will be described in which the user changes the print sheet that is used, and the carry amount correction pattern is printed in order to set a correction amount that is suited for the print sheet that has been exchanged.

The user sets in the color inkjet printer 3020 a print sheet that he would like to use, and from the computer 3090 connected to the color inkjet printer 3020, he carries out an operation for transmitting a command signal for printing the carry amount correction pattern.

The color inkjet printer 3020 receives the command signal for printing and a carry amount correction pattern print signal TPS from the computer 3090, and starts printing.

When the color inkjet printer 3020 receives the carry amount correction pattern print signal TPS, a "1" is set in the correction amount update counter Y provided inside the system controller 3054 (S3101), and a signal to be input to the sub-scan drive circuit 3062, which drives the paper carry motor 3031, is set so that the carry amount for each of the virtual circumference segments (1) to (8) of the paper carry roller 3024 is $\{(1/8)+(-4\times 1/1440)\}$ inch (S3102). The correction amount update counter Y is a counter that is incremented each time the correction amount is changed.

Then, the reference position of the paper carry roller 3024 is detected by the position detection sensor, and based on the signal of the encoder 3035, the print sheet P is carried to a predetermined print position (S3103).

When the print sheet arrives at the print position, a print counter X that is provided inside the system controller 3054 is set to "1" (S3104). The print counter X is a counter that is incremented each time the carriage 3028 performs scanning once for printing.

When the print counter X is set to "1," the carriage 3028 performs scanning to the right in the drawing while a structural pattern is printed in region A, as shown in FIG. 9A, by the α nozzle group of the regions c to f of the print head 3036 (S3105). After the structural pattern is printed, the paper carry roller 3024 is driven by the paper carry motor 3031, and the print sheet is carried for $\{(1/8)+(-4\times 1/1440)\}$ inch by the circumference (1) of the paper carry roller 3024 (S3106).

After the print sheet is carried by the circumference (1) of the paper carry roller 3024, the carriage 3028 performs scanning to the left while a structural pattern is printed in region B, as shown in FIG. 9B, by the α nozzle group of the regions c to f of the print head 3036, and then a structural pattern is printed in the region A by the β nozzle group of the regions b to e of the print head 3036, forming the pattern of the region A (S3107).

After the pattern of the region A is formed, the print counter X is incremented to "2" (S3108). If the print counter X has a value smaller than "8," then the cycle of carrying the print sheet by the virtual circumference segment and printing structural patterns is repeated (S3109). Thus, after the pattern of the region A is formed, the paper carry roller 3024 is driven and the print sheet is carried for $\{(1/8)+(-4\times 1/1440)\}$ inch by the circumference (2) of the paper carry roller 3024 (S3106).

After the print sheet is carried by the circumference (2) of the paper carry roller 3024, the carriage 3028 performs scanning to the right as a structural pattern is printed in the region B, as shown in FIG. 9C, by the β nozzle group of the regions b to e of the print head 3036 thereby forming a pattern, and then, a structural pattern is printed in region C by the α nozzle group of the regions c to f of the print head 3036 (S3107). In this way, the print sheet is carried by the virtual circumference segments and printed repeatedly until the print counter X becomes "8," forming the patterns of the regions A to G and printing a structural pattern in region H.

When the print counter X becomes "8," the paper carry roller 3024 is driven and the print sheet is carried for $\{(1/8)+(-4\times 1/1440)\}$ inch by the circumference (8) of the paper carry roller 3024 (S3110). After the print sheet is carried by the circumference (8) of the paper carry roller 3024, the carriage 3028 performs scanning as a structural pattern is printed in the region H by the β nozzle group of the regions b to e of the print head 3036, forming the pattern of the region H, at which point the paper carry roller 3024 has made a full rotation and the first pattern group (FIG. 6), which is made of the eight patterns and obtained when all virtual circumference segments (1) to (8) are each fed for $\{(1/8)+(-4\times 1/1440)\}$ inch, is formed.

When the paper carry roller 3024 has made a full rotation, the correction amount update counter Y is confirmed (S3112), and if the correction amount update counter Y is less than "9," then the correction amount update counter Y is incremented (S3113). Furthermore, a signal to be input to the sub-scan drive circuit 3062 for driving the paper carry motor 3031 is set so that the carry amount of each virtual circumference segment (1) to (8) of the carry roller 3024 becomes $\{(1/8)+(-3\times 1/1440)\}$ inch (S3102), and based on a signal from the encoder 3035, the print sheet is carried to a predetermined print position (S3103), and the carry error caused by paper carrying, including the correction amount, is removed. Then, in the same manner as the first pattern group, a second pattern group (FIG. 6), which is made of the eight patterns that are formed by printing structural patterns after performing carrying by each of the virtual circumference segments (1) to (8) to thereby form patterns and carrying the print sheet by $\{(1/8)+(-3\times 1/1440)$ inch, is formed.

Then, the correction amount settings are changed and pattern groups are formed repeatedly until it is confirmed that the correction amount update counter Y has reached "9," at which point nine pattern groups are formed, thereby printing the carry amount correction pattern.

In this embodiment, an example was shown in which printing was performed when performing scanning with the carriage 3028 in both the left and the right directions; however, it is also possible to print only when performing scanning in one direction. Also, in order to shorten the scan distance, by moving the carriage 3028 from its position after printing is over in each scan to the print start position for the next scan, the amount of time required for printing the carry amount correction pattern can be reduced.

In this embodiment, an example was shown in which patterns are formed by printing the structural patterns that are printed before and after the print sheet is carried so that they overlap one another; however, it is also possible to regard the position that would evenly divide the space between each dot row of the structural pattern having been printed before carrying as an ideal printing position at which each dot row of the structural pattern is to be printed after carrying. In this case, it is preferable to use a print head that has two black nozzle rows each arranged in the sub-scanning direction and in which nozzles are provided at an equal pitch, and where the position of the nozzles in one nozzle row is shifted, in the sub-scanning direction by half the nozzle pitch, with respect to the position of the nozzles in the other row.

Then, the structural pattern that is printed before carrying and the structural pattern that is printed after carrying can be made by printing using different nozzle rows. At this time, if the carry amount at which carrying is performed by a predetermined virtual circumference segment is accurate, then the density of the pattern will increase, and if there is an error in the carry amount, then the density of the pattern will decrease.

<Other Considerations>

In the foregoing, a printing apparatus, for example, according to an aspect of the invention was described based on the present embodiment; however, the foregoing embodiment of the present invention is for the purpose of facilitating understanding of the present invention and is not for the purpose of limiting the present invention. The invention can of course be altered and improved without departing from the gist thereof and includes functional equivalents.

It is also possible to achieve a computer system comprising: a printer having the printer main unit according to the above-described embodiment and a printing-medium unit that is removably mounted to the printer main unit; a computer main unit; a display device such as a CRT; an input device such as a mouse or a keyboard; a flexible drive device; and a CD-ROM drive device. A computer system achieved in this manner is superior to conventional systems as an overall system.

The printer having the printer main unit according to the above-described embodiment and the printing-medium unit that is removably mounted to the printer main unit can also be given some of the functions or the mechanisms of a computer main unit, a display device, an input device, a flexible disk drive device, and a CD-ROM drive device. For example, the printer can be configured so as to have an image processing section for carrying out image processing, a display section for carrying out various types of displays, and a storage medium inserting/detaching section to/from which a storage medium storing image data captured by a digital camera or the like can be inserted and taken out.

According to the present embodiment, it is possible to achieve a printing apparatus with which a carry amount correction pattern, which is for determining the correction amount of the carry amount of the print sheet, can be printed for each predetermined area obtained by segmenting, a carry amount correction pattern printed by the printing apparatus, a computer program for realizing a function for making the printing apparatus print the carry amount correction pattern, a computer system having the printing apparatus, and a printing method for printing the carry amount correction pattern using the printing apparatus.

What is claimed is:

1. A printing apparatus comprising:

a carry roller for carrying a print sheet;

wherein said carry roller has virtual circumference segments that are obtained by virtually dividing a circumference of the carry roller into a plurality of segments in a direction in which the carry roller is rotated, and said printing apparatus prints a plurality of patterns for each of said virtual circumference segments, each of said patterns corresponding to a different correction amount, and for each virtual circumference segment, sets a correction amount corresponding to one of the patterns.

2. A printing apparatus according to claim 1, wherein said printing apparatus forms at least one of the patterns for determining a correction amount for a predetermined virtual circumference segment by printing a predetermined structural pattern before and after the print sheet is carried by that virtual circumference segment of said carry roller.

3. A printing apparatus according to claim 2, wherein the plurality of patterns for each of said virtual circumference segments are formed starting from a front end side of the print sheet in order of the correction amounts.

4. A printing apparatus according to claim 2, wherein said structural pattern is made of a plurality of lines spaced at an equal spacing in a carry direction of the print sheet, or dot rows arranged in a direction that is perpendicular to said carry direction, and a correction amount is set corresponding to at least one of the patterns in which said lines or said dot rows of the structural pattern that is printed after carrying said print sheet are formed at a position that evenly divides a space between said lines or said dot rows of the structural pattern that is printed before carrying said print sheet.

5. A printing apparatus according to claim 2, wherein said structural pattern is made of a plurality of lines spaced at an equal spacing in a carry direction of the print sheet, or dot rows arranged in a direction that is perpendicular to said carry direction, and a correction amount is set corresponding to the at least one of the patterns in which said lines or said dot rows of the structural pattern, that is printed after carrying said print sheet, overlap said lines or said dot rows of the structural pattern that is printed before carrying said print sheet.

6. A printing apparatus according to claim 1, wherein the patterns, which correspond to the correction amounts for each of the virtual circumference segments, are arranged in a row in a carry direction of the print sheet for each of the virtual circumference segments, and the pattern rows, which are arranged in rows, are printed on a single print sheet in a direction that is perpendicular to said carry direction.

7. A printing apparatus according to claim 1, wherein said printing apparatus is capable of forming a pattern group by forming patterns for each of said virtual circumference segments corresponding to one correction amount, and changing said correction amount each time said carry roller makes a full turn and forming said pattern group made of patterns corresponding to the correction amount that has been changed.

8. A printing apparatus according to claim 7, further comprising a print head for printing while performing scanning in a direction that is perpendicular to a carry direction of said print sheet;

wherein as for two adjacent patterns that make up one of said pattern groups, a structural pattern printed before carrying in one pattern and a structural pattern printed after carrying in another pattern are printed during the same scan of the print head.

9. A printing apparatus according to claim 8, wherein said print head has a plurality of nozzles that are arranged in the carry direction of said print sheet and that are capable of ejecting ink, said patterns are formed using some of said nozzles, and nozzles forming the structural pattern printed after said carrying by a particular virtual circumference segment are located more toward the front end of the print sheet than nozzles forming the structural pattern printed before said carrying.

10. A printing apparatus according to claim 1, wherein a length of each said pattern in said carry direction is shorter than a product of an amount the print sheet is carried and a number into which said carry roller is virtually divided.

11. A printing apparatus comprising:

a carry roller for carrying a print sheet, said carry roller has virtual circumference segments that are obtained by virtually dividing a circumference of the carry roller into a plurality of segments in a direction in which the carry roller is rotated, said printing apparatus prints a plurality of patterns for each of said virtual circumference segments, each of said patterns corresponding to a different correction amount, for each virtual segment, sets a correction amount corresponding to one of the patterns, prints a predetermined structural pattern before and after the print sheet is carried by a predetermined virtual circumference segment of said carry roller, and forms a pattern for determining a correction amount for that virtual circumference segment, the patterns, which correspond to the correction amounts for each of the virtual circumference segments, are arranged in a row in a carry direction of the print sheet for each of the virtual circumference segments, the pattern rows, which are arranged in rows, are printed on a single print sheet arranged in a direction that is perpendicular to said carry direction, the plurality of patterns for each of said virtual circumference segments corresponding to one correction amount are formed starting from a front end side of the print sheet in order of formation of the patterns, said printing apparatus further forms a pattern group by forming patterns for each of said virtual circumference segments corresponding to one correction amount, and changes said correction amount each time said carry roller makes a full turn and forms group made of patterns corresponding to the correction amount that has been changed, said printing apparatus further comprises a print head for printing while performing scanning in a direction that is perpendicular to a carry direction of said print sheet, as for two adjacent patterns that make up one of said pattern groups, a structural pattern printed before carrying in one pattern and a structural pattern printed after carrying in another pattern are printed during the same scan of the print head, said print head has a plurality of nozzles that are arranged in the carry direction of said print sheet and that are capable of ejecting ink, said patterns are formed using some of said nozzles, nozzles forming the structural pattern printed after said carrying by a particular virtual circumference segment are located more toward the front end of the print sheet than nozzles forming the structural pattern printed before said carrying, a length of each said pattern in said carry direction is shorter than a product of an amount the print sheet is carried and a number into which said carry roller is virtually divided, said structural pattern is made of a plurality of lines spaced at an equal spacing in a carry direction of the print sheet, or dot rows arranged in a direction that is perpendicular to said carry direction, and a correction amount is set corresponding to at least one of the patterns in which said lines or said dot rows of the structural patterns that is printed after carrying said print sheet, are formed at a position that evenly divides a space between said lines or said dot rows of the structural pattern that is printed before carrying said print sheet.

12. A storage medium having a program recorded thereon, comprising:

the storage medium for storing the program;

wherein said program makes a printing apparatus that has a carry roller for carrying a print sheet:

print a plurality of patterns for each of a plurality of virtual circumference segments, each of said patterns corresponding to a different correction amount, and each of said virtual circumference segments being obtained by virtually dividing a circumference of said carry roller into a plurality of segments in a direction in which the carry roller is rotated, and for each virtual circumferential segment, set a correction amount corresponding to one of the patterns.

13. A computer system comprising:

a computer main unit; and a printing apparatus that has a carry roller for carrying a print sheet and that is capable of being connected to said computer main unit;

wherein said carry roller has virtual circumference segments that are obtained by virtually dividing a circumference of the carry roller into a plurality of segments in a direction in which the carry roller is rotated, and said printing apparatus prints a plurality of patterns for each of said virtual circumference segments, each of said patterns corresponding to a different correction amount, and for each virtual circumference segment, sets a correction amount corresponding to one of the patterns.

14. A printing method comprising:

printing a plurality of patterns for each of a plurality of virtual circumference segments, each of said patterns corresponding to a different correction amount, and each of said virtual circumference segments being obtained by virtually dividing a circumference of a carry roller into a plurality of segments in a direction in which the carry roller is rotated, and for each virtual circumference segment, setting a correction amount corresponding to one of the patterns.

* * * * *